US008240247B2

(12) United States Patent
Wincott et al.

(10) Patent No.: US 8,240,247 B2
(45) Date of Patent: Aug. 14, 2012

(54) COMPACTING APPARATUS

(75) Inventors: Philip Wincott, Telford (GB); Barry George Carson, Telford (GB)

(73) Assignee: Lyndex Recycling Systems Limited, Walsall (GB)

( * ) Notice: Subject to any disclaimer, the term of this patent is extended or adjusted under 35 U.S.C. 154(b) by 540 days.

(21) Appl. No.: 12/307,830

(22) PCT Filed: Jul. 6, 2007

(86) PCT No.: PCT/GB2007/002523
§ 371 (c)(1),
(2), (4) Date: Jul. 2, 2009

(87) PCT Pub. No.: WO2008/007057
PCT Pub. Date: Jan. 17, 2008

(65) Prior Publication Data

US 2010/0018415 A1 Jan. 28, 2010

(30) Foreign Application Priority Data

Jul. 8, 2006 (GB) ..... 0613601.4

(51) Int. Cl.
*B65B 13/20* (2006.01)
*B30B 9/30* (2006.01)

(52) U.S. Cl. ..... 100/3; 100/19 R; 100/190; 100/98 R; 100/215; 100/233; 100/255

(58) Field of Classification Search ..... 100/35, 100/42, 190, 191, 192, 98 R, 215, 232, 233, 100/240, 245, 3, 7, 19 R, 24, 255
See application file for complete search history.

(56) References Cited

U.S. PATENT DOCUMENTS

| | | | | |
|---|---|---|---|---|
| 3,667,377 | A * | 6/1972 | Persson | 100/19 R |
| 4,125,068 | A | 11/1978 | Linnerz et al. | |
| 4,573,403 | A | 3/1986 | Van Doorn | |
| 4,594,942 | A | 6/1986 | Denneboom | |
| 4,651,610 | A * | 3/1987 | Schwelling | 83/636 |
| 5,193,454 | A * | 3/1993 | Bollegraaf | 100/142 |
| 5,203,261 | A * | 4/1993 | Davis | 100/42 |
| 5,832,815 | A * | 11/1998 | Bollegraaf | 100/42 |
| 5,845,568 | A * | 12/1998 | Rosser, Jr. | 100/190 |
| 6,694,871 | B1 * | 2/2004 | Wildes et al. | 100/190 |
| 7,343,852 | B2 * | 3/2008 | Olds | 100/190 |
| 2007/0028787 | A1 * | 2/2007 | Olds | 100/240 |

FOREIGN PATENT DOCUMENTS

| | | |
|---|---|---|
| DE | 3926907 A1 | 2/1991 |
| DE | 9315162 U1 | 2/1994 |
| EP | 0447694 A1 | 9/1991 |
| EP | 1749650 A | 2/2007 |

* cited by examiner

*Primary Examiner* — Jimmy T Nguyen
(74) *Attorney, Agent, or Firm* — Chernoff, Vilhauer, McClung & Stenzel, LLP

(57) ABSTRACT

Compacting apparatus (10) for waste material defines a feed space (14), in which material (16) for compacting is received in use, and a pressing chamber (16). The apparatus includes a moving assembly (40) for moving material from the feed space into the pressing chamber, a pressing member (20) movable within the pressing chamber to move material in use out of the pressing chamber, and a shearing arrangement (70, 72) for shearing the material as it moves out of the pressing chamber.

10 Claims, 5 Drawing Sheets

COMPACTING APPARATUS

This is a national stage application filed under 35 USC 371 based on International Application No. PCT/GB2007/002523 filed Jul. 4, 2007, and claims priority under 35 USC 119 of United Kingdom Patent Application No. 0613601.4 Jul. 8, 2006.

The present invention relates to compacting apparatus, particularly but not exclusively compacting apparatus for waste material.

Conventionally, compacting apparatus is used to compact loose waste material into bales to facilitate handling. The loose waste material can include waste paper, cardboard or plastics material for recycling. Frequently the waste material is sorted before compacting, so that a compacting apparatus may be run for a period of time compacting, for example, cardboard, and then be switched over to compacting plastic bottles. Alternatively, at other times the compacting apparatus may compact mixed solid waste, which consists of unsorted material. Each material requires different machine settings for optimum operation to reduce the frequency of blockages occurring which cause downtime and increase inefficiency. However, waste material is not a consistent or homogenous material and blockages frequently occur. Typically such compacting apparatus utilises relatively powerful hydraulically powered actuator means to provide a compaction force and includes sensors to detect blockages and prevent the actuator means damaging the machine itself.

According to a first aspect of the present invention, there is provided compacting apparatus for waste material, the apparatus defining a feed space in which material for compacting is received in use and a pressing chamber, the apparatus including moving means for moving material from the feed space into the pressing chamber, a pressing member movable within the pressing chamber to move material in use out of the pressing chamber, and shear means for shearing the material as it moves out of the pressing chamber.

Possibly, the moving means include a flap assembly. Possibly, the moving means include mounting means for mounting the flap assembly. Possibly, the mounting means mount the flap assembly in the feed space, and may mount the flap assembly above the pressing chamber. Possibly, the mounting means pivotally mount the flap assembly, and may pivotally mount the assembly around an axis parallel to the direction of movement of the pressing member. Possibly, the flap assembly is movable between a retracted position and an extended position. Possibly, as the flap assembly moves from the retracted to the extended position, material in the feed space is moved into the pressing chamber. Possibly, as the flap assembly moves from the retracted to the extended position, material is compressed within the pressing chamber.

Possibly, the flap assembly is arranged to permit receipt of material into the feed space when the flap assembly is in both the extended and the retracted positions. Possibly, the flap assembly includes a flap member. Possibly, the flap assembly includes a cover member, which may extend from a free edge of the flap member, and may be arranged to hold material when the flap assembly is in the extended position.

Possibly, the cover member is curved, and may have a centre of curvature which is substantially located on the mounting axis of the flap assembly.

Possibly, the feed space is partly defined by the flap member when the flap assembly is in the retracted position. Possibly, the feed space is partly defined by the cover member when the flap assembly is in the extended position.

Possibly, the flap assembly includes reinforcement means. Possibly, the reinforcement means include a reinforcement member which extends along one end of the cover member, and may form part of the cover member.

Possibly, the apparatus includes a plurality of flap assemblies, and may include two opposed flap assemblies, which may be substantially similar. Possibly, the flap member of one flap assembly is relatively larger than the flap member of the other flap assembly. Possibly, in the extended position, a gap is defined between the opposed flap members. Possibly, as the pressing member moves material out of the pressing chamber, any material in the gap is sheared.

Possibly, the moving means includes flap assembly actuation means for moving the or each flap assembly.

Possibly, the apparatus includes pressing member actuation means for moving the pressing member.

Possibly, the apparatus defines a compression channel. Possibly, in use, the pressing member moves the material from the pressing chamber into the compression channel. Possibly, the compression channel tapers in the direction of movement of the material. Possibly, the compression channel is defined by a plurality of walls. Possibly, at least one of the side walls is movable. Possibly, the apparatus includes wall actuation means for moving the wall or walls.

Possibly, the apparatus includes guide means, which may be arranged to guide the movement of material from the gap. Possibly, the guide means include a guide surface, which may be formed on the or each reinforcement member.

Possibly, the shear means include a first blade which may be mounted to the pressing member. Possibly, the shear means include a second blade which may partly define the compression channel.

Possibly, the feed space is defined by a feed hopper

Possibly, the apparatus includes tying means for tying one or a plurality of tie members around a length of the compacted material in the compression channel to form a bale. Possibly, the tying means include one or a plurality of needle members. Possibly, the pressing member defines one or a plurality of needle receiving passages, each of which may receive in use one of the needle members. Possibly, the apparatus is arranged so that in use the passage or passages does not substantially permit communication of material from the gap to the or any passage.

According to a second aspect of the present invention, there is provided a method of compacting waste material, the method including the steps of receiving waste material in a feed space, moving the material from the feed space into a pressing chamber, moving the material out of the pressing chamber and shearing the material as it moves out of the pressing chamber.

Possibly, the method includes the step of providing compacting apparatus as described in any of the preceding statements.

An embodiment of the present invention will now be described, by way of example only, and with reference to the accompanying drawings, in which:—

Figure 1:
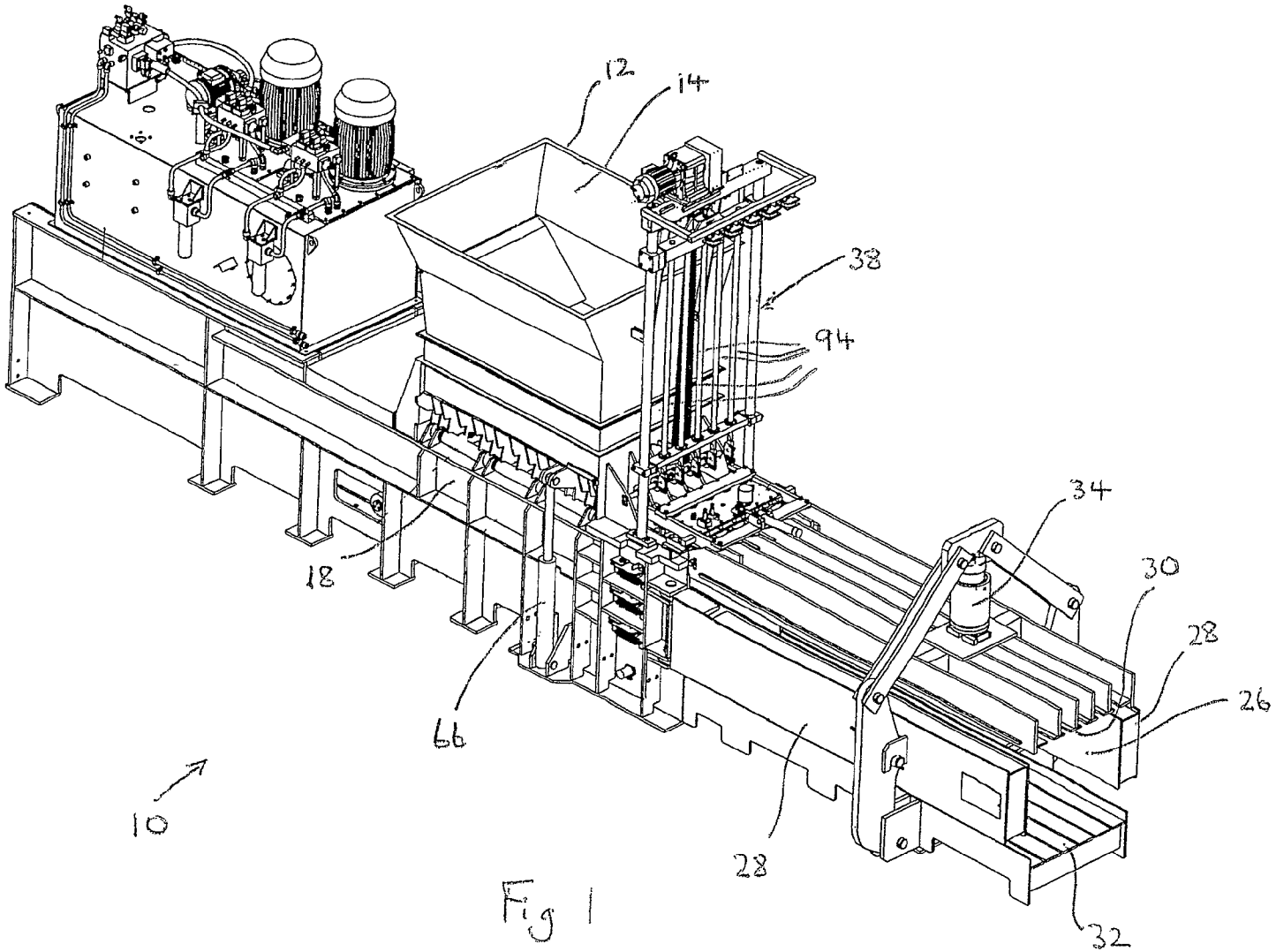
FIG. 1 is a perspective view of a compacting apparatus.
Figure 2:
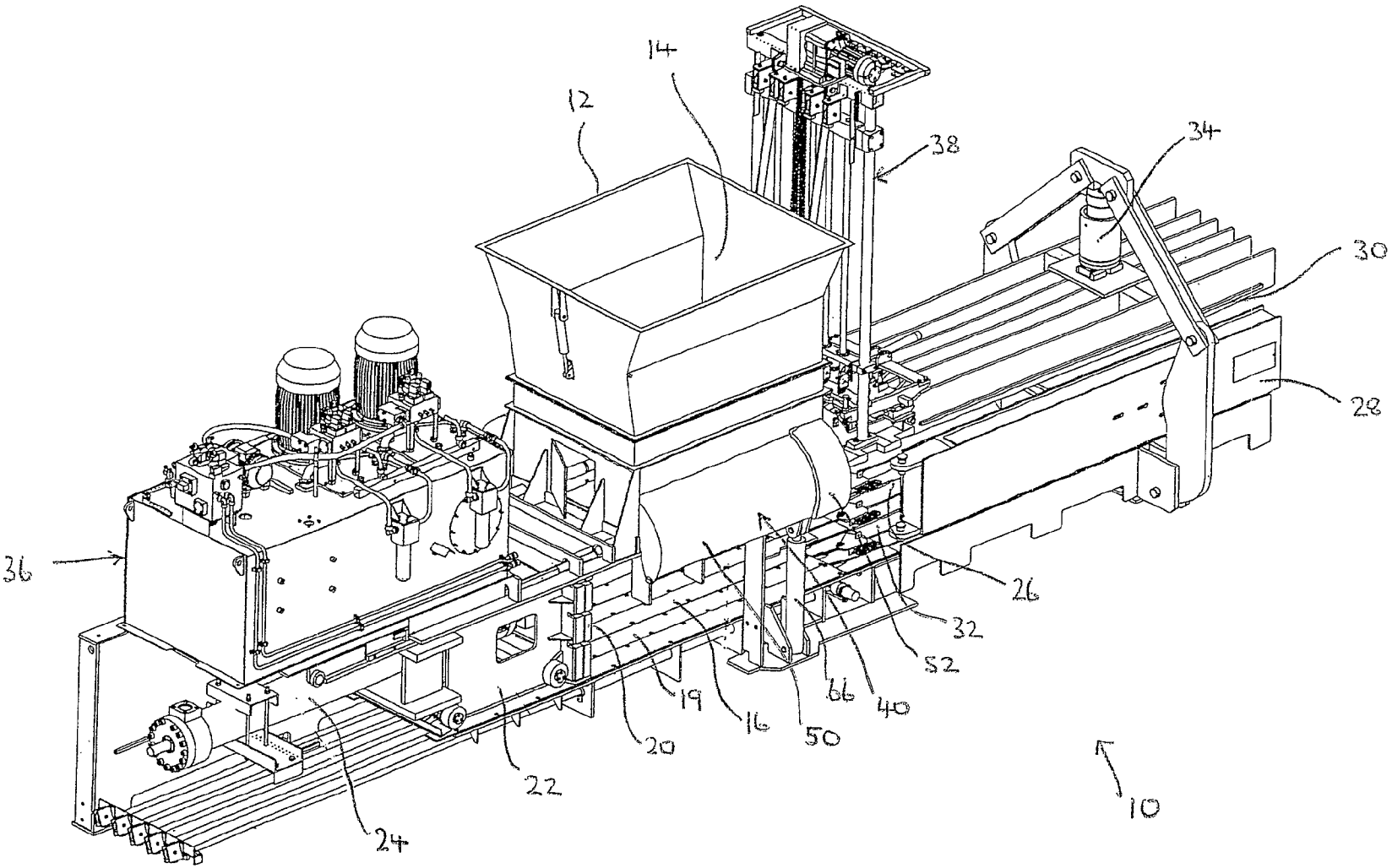
FIG. 2 is another perspective view of the compacting apparatus of FIG. 1, with part of the apparatus removed to permit internal components to be seen.

FIGS. 1 and 2 show a compacting apparatus 10, the compacting apparatus 10 including a feed hopper 12 defining a feed space 14, the feed hopper 12 being located above a pressing chamber 16 (FIGS. 3 to 6) defined by pressing chamber side walls 18 and a pressing chamber base wall 19. The apparatus 10 includes a pressing member 20 which is movable within the pressing chamber 16. The pressing member 20 is mounted to a trolley 22. The apparatus 10 includes pressing member actuation means for moving the trolley 22 in the form of a pressing cylinder 24 which, in this example, is a hydraulic cylinder. The apparatus 10 includes an hydraulic power pack 36 in communication with the pressing cylinder 24 to move the trolley 22. The trolley 22 includes a trolley top wall 56 which extends rearwardly from the pressing member 20.

The apparatus 10 includes compression channel side walls 28, a compression channel top wall 30 and a compression channel base wall 32 which together define a compression channel 26. The pressing chamber side walls 18 and pressing chamber base wall 19 are substantially continuous with the compression channel side walls 28 and compression channel base wall 32 respectively. The compression channel side walls 28 and compression channel top wall 30 are movable relative to the compression channel base wall 32. The apparatus 10 includes wall actuation means in the form of a compression channel cylinder 34 for moving the compression channel side walls 28 and the compression channel top wall 30, the compression channel cylinder 34 in this example being a hydraulic cylinder, which is in communication with the hydraulic power pack 36.

The apparatus 10 includes tying means in the form of a tying assembly 38, which includes a plurality of needle members 94.

Figure 3:
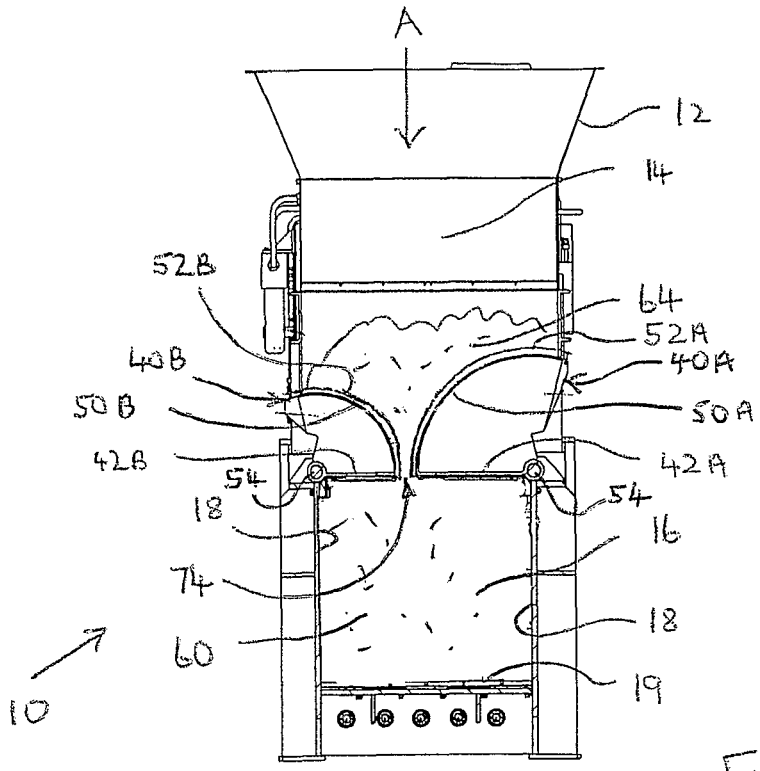
FIG. 3 is a transverse cross sectional view of the apparatus of FIGS. 1 and 2 with flap assemblies in an extended position.
Figure 4:
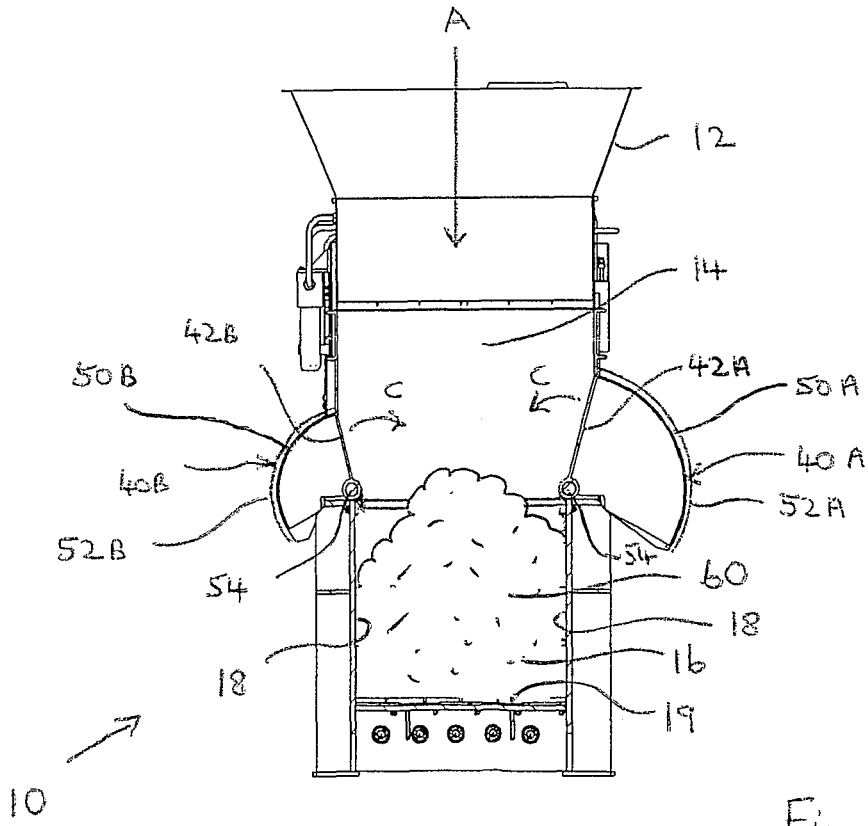
FIG. 4 is a transverse cross sectional view of the apparatus of FIGS. 1 and 2 with the flap assemblies in a retracted position.

The compacting apparatus 10 includes moving means in the form of a pair of opposed flap assemblies 40A, 40B as shown in FIGS. 3 and 4. Each flap assembly 40 includes a substantially planar flap member 42 and a curved convex cover member 50 which extends from a free edge of each flap member 42.

The moving means include mounting means for mounting each flap assembly 40, the mounting means including a pair of pivot mountings 50, each pivot mounting 50 mounting one flap assembly 40 so that each assembly 40 pivots around an axis parallel to the direction of movement of the pressing member 20. Each cover member 50 has a centre of curvature which is substantially located on the mounting axis of the flap assembly 40.

Each flap assembly 40 is pivotally movable between an extended position and a retracted position. In the retracted position, the flap members 42A, 42B partly define the feed space 14 forming a substantially continuous surface with the feed hopper 12, and material can fall by gravity from the feed space 14 into the pressing chamber 16. When each flap assembly 40 is in the extended position, the flap members 42A, 42B substantially close the top of the pressing chamber 16, dividing the pressing chamber 16 from the feed space 14. In the extended position, the cover members 50A, 50B form a substantially continuous surface with the feed hopper 12.

In the extended position, a gap 74 is defined between the flap members 42A, 42B.

Figure 6:
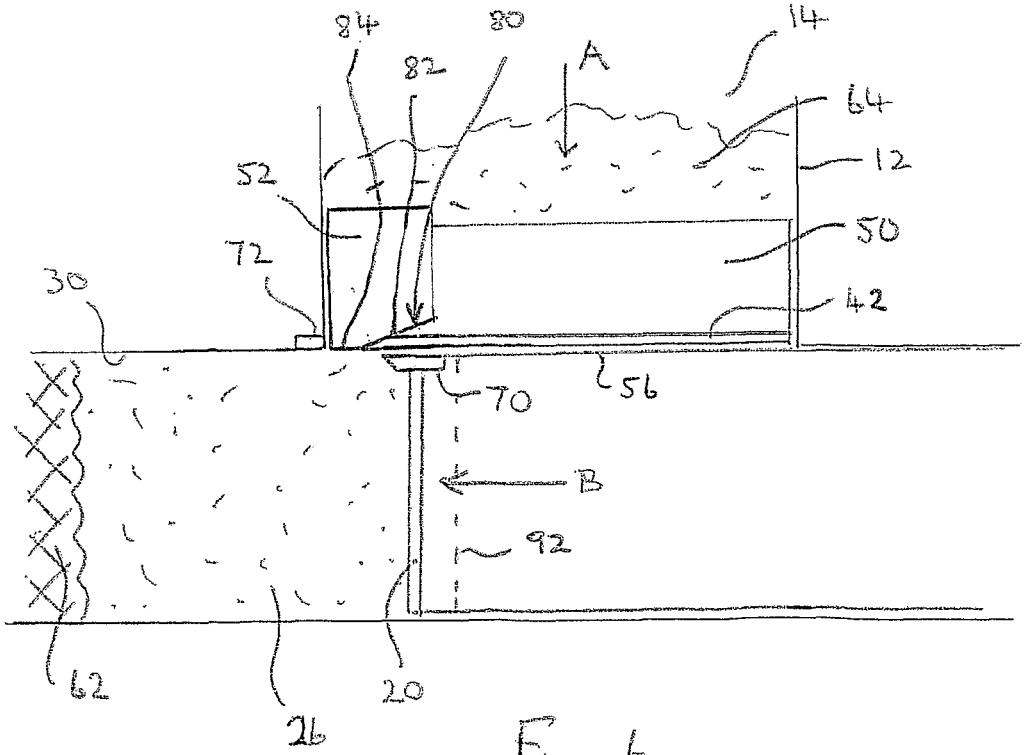
FIG. 6 is a longitudinal cross sectional view of part of the apparatus of FIGS. 1 and 2 with the flap assemblies in the extended position.

Each flap assembly 40 includes reinforcement means including a reinforcement member 52 which extends along an end of each cover member 50 towards the compression channel 26. As shown in FIG. 6, each reinforcement member 52 includes guide means in the form of a guide surface 80, which is formed on the free edge of the reinforcement member 52 in the gap 74. The guide surface 80 includes a first angled part 82, which is angled relative to the flap member 42 and a second part 84 towards the compression channel 26 which is substantially coplanar with the flap member 42.

In one example, the first angled part 82 could have a length of approximately 200 mm, and the second part 84 could have a length of approximately 100 mm. The first angled part 82 could subtend an included angle with the second part 84 of between 135° and 175°, and optimally could subtend an included angle of approximately 166°.

Figure 7:
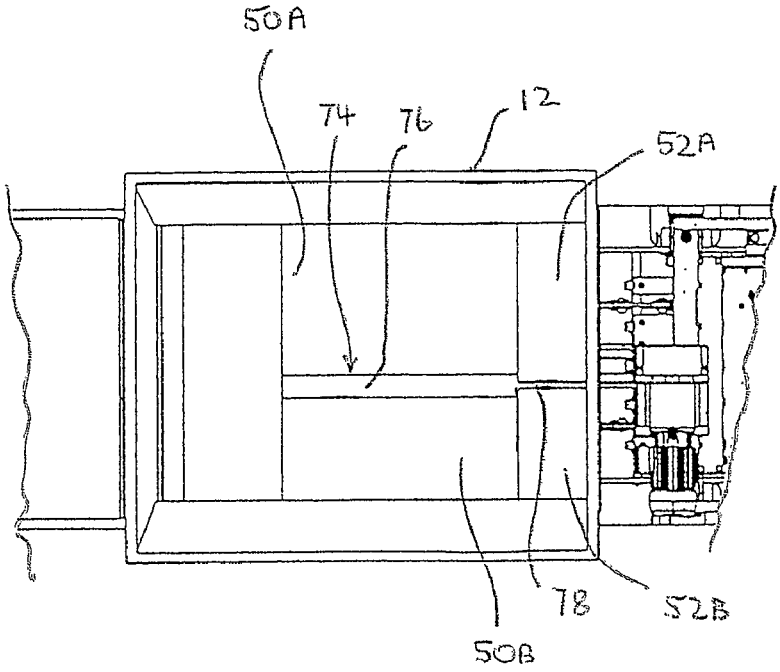
FIG. 7 is a plan view of part of the apparatus of FIGS. 1 and 2 with the flap assemblies in the extended position.

Referring to FIG. 7, it will be noted that in the extended position, the reinforcement members 52 narrow the gap 74 towards the compression channel 26, so that the gap 74 includes a wider part 76 and a narrower part 78.

In one example, the wider part 76 could have a dimension in the range of 100 mm to 200 mm, and the narrower part 78 could have a dimension in the range 25 mm to 100 mm. Optimally, the wider part 76 could have a dimension of approximately 150 mm, and the narrower part 78 could have a dimension of approximately 50 mm.

The moving means include flap assembly actuation means for moving the flap assemblies 40 in the form of flap assembly cylinders 66 which, in this example, are hydraulic cylinders in communication with the hydraulic power pack 36.

Figure 5:
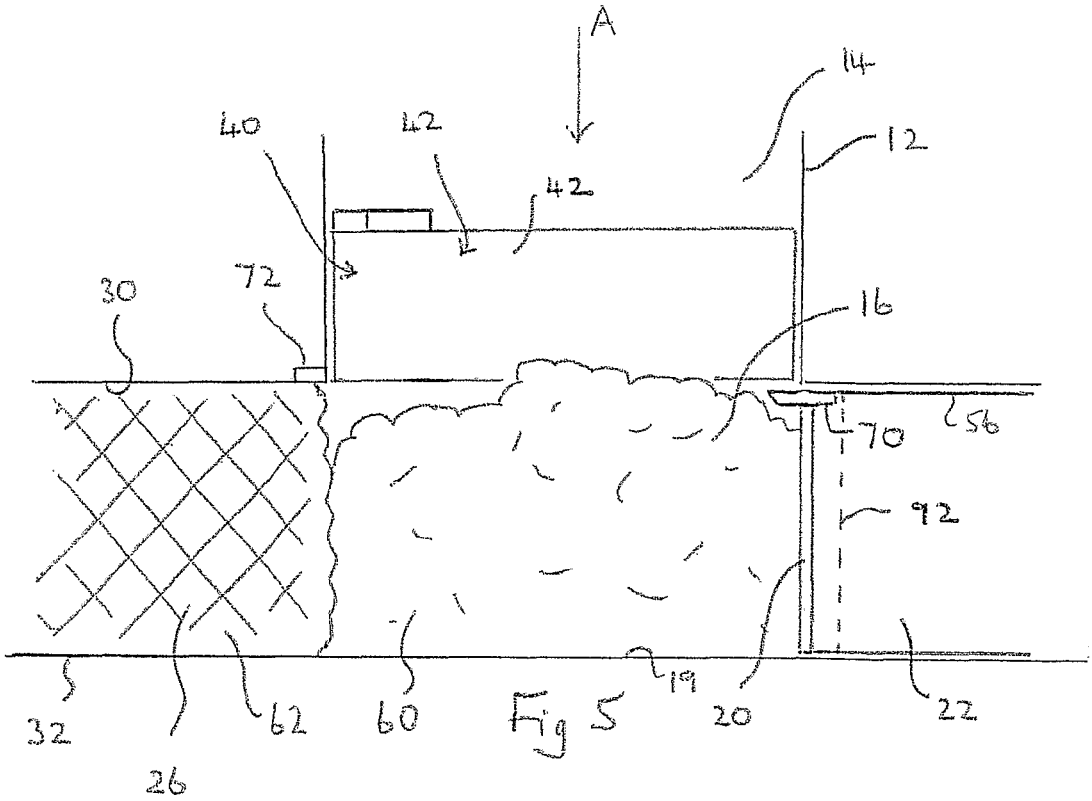
FIG. 5 is a longitudinal cross sectional view of part of the apparatus of FIGS. 1 and 2 with the flap assemblies in the retracted position.

Referring to FIGS. 5 and 6, the apparatus 10 includes shear means, the shear means including a first blade 70 mounted to a top edge in use of the pressing member 20 and a second blade 72 mounted along a lower edge in use of the feed hopper 12 within and partly defining the compression channel 26.

Figure 8:
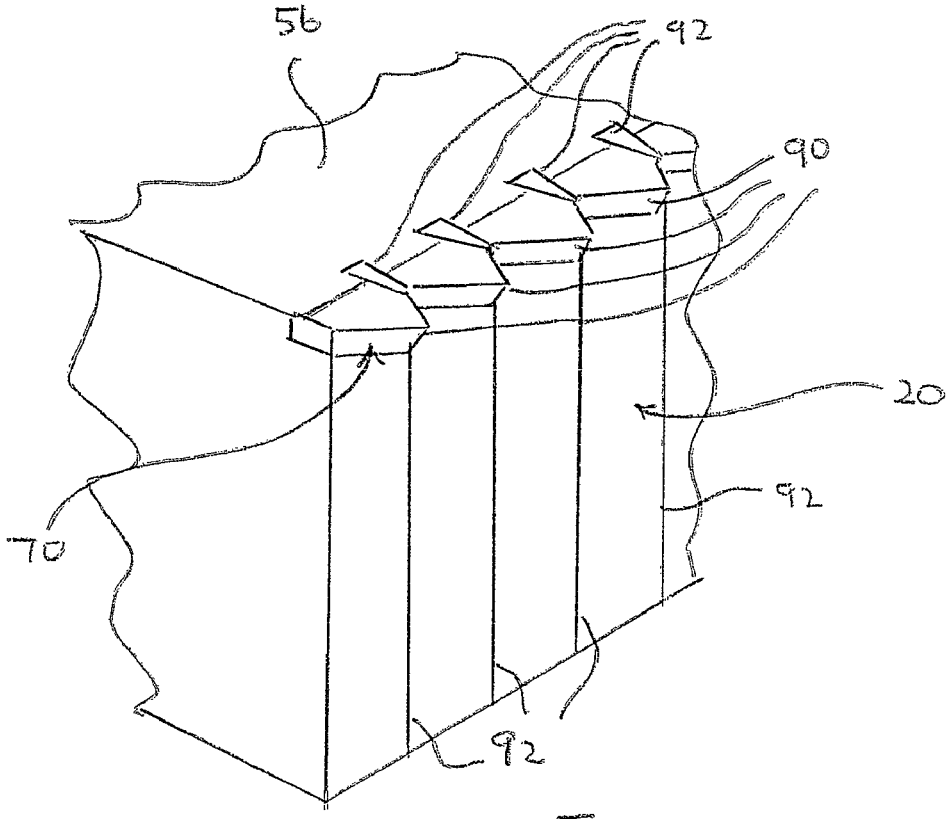
FIG. 8 is a perspective view of part of a pressing member.

FIG. 8 shows part of the pressing member 20 in more detail. The first blade 70 comprises a plurality of first blade parts 90, each blade part 90 being in the form of a tooth. The pressing member 20 defines a plurality of needle receiving passages 92. Each passage 92 is in the form of a slot which extends from the trolley top wall 56, between a pair of the first blade parts 90 and substantially vertically down the pressing member 90, dividing the pressing member 90 into a plurality of parts. Each passage 92 is substantially wedge shaped in plan, being relatively narrower at the front face of the pressing member 20 and relatively broader away from the front face of the pressing member 20.

In use, loose waste material is fed as shown by arrow A in FIGS. 3 and 4 into the feed hopper 12. Initially, the flap assemblies 40A, 40B are in the retracted position, and the loose waste material falls through the feed space 14 and into the pressing chamber 16.

The compacting apparatus 10 can be operated in a number of different modes, which could depend on the waste material being compacted. For example, in one operating mode, the pressing member 20 operates to move the material 60 in the pressing chamber 20 into the compression channel 26 before the pressing chamber 20 is full. In this operating mode, the flap assemblies 40 are not required to operate. As the pressing member 20 moves along the pressing chamber 16, the material 60 in the pressing chamber 16 may protrude out of the pressing chamber 16 into the feed space 14. Any protruding material will then be sheared between the cooperating first and second blades 70, 72 as the pressing member 20 passes beneath the compression chamber blade 72. This mode could be suitable, for example for relatively dense waste material.

Referring to FIG. 5, previously compacted material 62 substantially fills the compression channel 26, forming a wall against which the material 60 accumulates within the pressing chamber 16. As the pressing member 20 moves along the pressing chamber 16, the previously compacted material 62 is also moved along the compression channel 26 as shown in FIG. 6.

In an example of another operating mode, the loose material 60 fills the pressing chamber 16 and protrudes into the feed space 14 as shown in FIG. 5. When the material 60 protrudes into the feed space 14 by a defined amount, a sensor (not shown) provides a signal to a controller (not shown) which operates the flap assemblies 40, moving the flap assemblies 40 from the retracted position as shown in FIG. 4 to the extended position as shown in FIG. 3 (arrows C in FIG. 4). The movement of the flap assemblies 40 from the retracted position to the extended position compresses the protruding material, moving the protruding material from the feed space 14 into the pressing chamber 16. For relatively low density materials, the flap assemblies 40 could then move back from the extended position to the retracted position and filling of the material could continue.

The flap assemblies 40 could then move again from the retracted position to the extended position moving further material 60 from the feed space 14 into the pressing chamber 16, further compacting the material 60 in the pressing chamber 16. This cycle could be repeated until compaction of the material 60 in the pressing chamber 16 has reached a predetermined level. The flap assemblies 40 then remain in the extended position, and the pressing member 20 moves as shown by arrow B in FIG. 6 along the pressing chamber 16 to further compact the material 60 and move the material 60 from the pressing chamber 16 into the compression channel 26.

Referring to FIG. 3, with the flap assemblies 40 in the extended position, filling of the material 60 can continue as shown by arrow A, the new material 64 accumulating on the cover members 50A, 50B which in this position are substantially continuous with the walls of the feed hopper 12. Subsequently, when the flap assemblies 40 move from the extended position to the retracted position, the material 64 accumulated on the cover members 50A, 50B falls into the pressing chamber 16. Thus the filling operation can be continuous.

The presence of the gap 74 reduces the risk of the material 60 lodging between the free edges of the flap members 42 and preventing operation thereof. Any material 60 which protrudes from the pressing chamber 16 through the gap 74 is either sheared in situ by the movement of the first blade 70, or is moved by the first blade 70 towards the second blade 72. As material 60 in the wider part 76 of the gap 74 is moved towards the compression channel 26, it is moved against the guide surface 80, which guides the material 60 downwardly below the second blade 72 into the compression channel 26, thus reducing the amount of material requiring shearing between the first and second blades 70, 72 and reducing the risk of blockage in the gap 74.

As the pressing member 20 moves along the pressing chamber 16, the material 60 being compacted exerts a force on the flap members 42 to move the flap members 42 upwardly away from the pressing chamber 16. The reinforcement members 52 reinforce the flap assemblies 40 to permit a larger counterforce to be applied by the flap assembly cylinders 66 to reduce the movement of the flap assemblies 40. The reinforcement members 52 thus permit greater compaction of the material 60 and reduce the risk of blockage, since a greater force can be applied to keep the under surface of the flap members 42 flush with the underside of the compression channel top wall 30.

As the pressing member 20 moves back along the pressing chamber 16, any material which has accumulated on the trolley top wall 56 or in the gap 74 falls into the pressing chamber 16.

The compression channel side walls 28 and compression channel top wall 30 are arranged so that the compression channel 26 tapers from the pressing chamber 16, so that as the material 60 moves along the compression channel 26 it is further compacted.

When the pressing member 20 reaches a forward position in the compression channel 26, the tying assembly 38 operates to tie a plurality of tie members (not shown) around a predetermined length of compacted material 62 in the compression channel 26 to form a bale. The needle members 94 are received in the needle receiving passages 92 to loop the tie members around the compacted material 62. The needle members 94 are relatively long, and any material in the passages 92 can easily damage the needle members 94. The apparatus 10 is therefore arranged so that in the extended position the gap 74 is offset from the positions of the passages 92 so that communication of material from the gap 74 to any of the passages 92 is not substantially permitted.

In one example, the tying assembly 38 could tie four tie members around the compacted material 62, and in another example the tying assembly 38 could tie five tie members around a length of the compacted material 62. To prevent the said communication of material, a tying assembly 38 tying four tie members could have for flap members 42 be of substantially equal width, and in the case of a tying assembly 38 tying five tie members, the flap members 42 could be of differing widths.

Various other modifications may be made without departing from the scope of the invention. The apparatus described could be used for compacting any suitable material. The compacting apparatus described could be in the form of a stand alone machine, or could form part of a baling machine. The various features and components described could be of any suitable size, shape or dimension. The actuation means could be different. The compacting apparatus could include any suitable number of flap assemblies. In one example, a compacting apparatus could be provided which includes only a single flap assembly. However, such an arrangement is relatively disadvantageous in that a single flap assembly requires a greater operating height, taking up more of the feed space 14 and a greater force to operate because of leverage effects. The flap assemblies 40 could be orientated differently. For example, the flap assemblies 40 could be orientated transversely across the pressing chamber 16. However, this arrangement is relatively disadvantageous in comparison with the orientation of the flap assemblies 40 in the longitudinal direction along the pressing chamber 16 since there is a greater possibility of blockages occurring, since the gap between the flap members is transverse to the direction of motion of the pressing member.

There is thus provided compacting apparatus which provides a number of advantages. The flap assemblies 40 permit faster compaction of relatively low density materials, reducing the number of movements of the pressing member 20 required and thus increasing machine efficiency. The arrangement of the flap assemblies 40, the gap 74 and the guide surfaces 80 help reduce the risk of blockage, further improving machine efficiency. The apparatus can be operated in a number of different modes, increasing flexibility.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. Compacting apparatus for waste material, the apparatus defining a feed space in which material for compacting is received in use and a pressing chamber, the apparatus including moving means for moving material from the feed space into the pressing chamber, a pressing member movable within the pressing chamber to move material in use out of the pressing chamber, and shear means for shearing the material as it moves out of the pressing chamber, wherein the moving means includes a pair of opposed flap assemblies moveable between a retracted and an extended position, the flap assemblies defining an off center, vertically open gap therebetween in the extended position, and wherein a flap member of one flap assembly is relatively larger than a flap member of the other flap assembly, the apparatus includes tying means for tying a plurality of tie members around a length of compacted material in a compression channel to form a bale, the tying means includes a plurality of needle members, the pressing member defines a plurality of needle receiving passages, each of which receives in use one of the needle members, the pressing member includes a first blade, the first blade comprises a plurality of first blade parts, each blade part being in the form of a tooth, with each needle receiving passage being located between a pair of the first blade parts, with one of the blade parts corresponding to a position of the gap, the apparatus is therefore arranged so that in the extended position the gap is offset from the positions of the needle receiving passages.

2. Apparatus according to claim 1, in which the moving means includes the pair of opposed flap assemblies, mounting means for pivotally mounting each of the flap assemblies in the feed space above the pressing chamber around an axis parallel to the direction of movement of the pressing member.

3. Apparatus according to claim 1, in which the moving means includes the pair of opposed flap assemblies, each of the flap assemblies includes the flap member, a curved cover member extending from a free edge of the flap member, the cover member being arranged to hold material in the feed space when each of the flap assemblies is in an extended position.

4. Apparatus according to claim 1, in which the moving means includes the pair of opposed flap assemblies, each of the flap assemblies includes the flap member, a curved cover member extending from a free edge of the flap member, the cover member being arranged to hold material in the feed space when each of the flap assemblies is in an extended position, each of the flap assemblies including reinforcement means, the reinforcement means including a reinforcement member, which extends along one end of the cover member.

5. Apparatus according to claim 1, in which the gap between the opposed flap members includes a wider part and a narrower part.

6. Apparatus according to claim 1, in which the apparatus defines the compression channel which tapers in the direction of movement of the material from the pressing chamber.

7. Apparatus according to claim 1, in which the apparatus defines the compression channel which is defined by a plurality of walls, at least one of which is movable.

8. Apparatus according to claim 1, in which the apparatus defines the compression channel and includes guide means which include a guide surface, to guide the material into the compression channel.

9. Apparatus according to claim 1, in which the moving means includes the pair of opposed flap assemblies, each of the flap assemblies includes the flap member, a curved cover member extending from a free edge of the flap member, the cover member being arranged to hold material in the feed space when each of the flap assemblies is in an extended position, each of the flap assemblies including reinforcement means, the reinforcement means including a reinforcement member, which extends along one end of the cover member, the apparatus defining the compression channel and including guide means which include a guide surface to guide the material into the compression channel, the guide surface being formed on the reinforcement member.

10. Apparatus according to claim 1, in which the apparatus defines the compression channel, the shear means include the first blade, the first blade being mounted to the pressing member, the shear means including a second blade, the second blade partly defining the compression channel.

* * * * *